US009285184B1

(12) United States Patent
Cianci

(10) Patent No.: US 9,285,184 B1
(45) Date of Patent: Mar. 15, 2016

(54) INTEGRATED GUN STOCK

(71) Applicant: James Charles Cianci, Harrison, NY (US)

(72) Inventor: James Charles Cianci, Harrison, NY (US)

( * ) Notice: Subject to any disclaimer, the term of this patent is extended or adjusted under 35 U.S.C. 154(b) by 5 days.

(21) Appl. No.: 14/552,007

(22) Filed: Nov. 24, 2014

(51) Int. Cl.
*F41C 23/00* (2006.01)
*F41C 23/16* (2006.01)
*F41C 23/20* (2006.01)

(52) U.S. Cl.
CPC ..... *F41C 23/16* (2013.01); *F41C 23/20* (2013.01)

(58) Field of Classification Search
CPC ..... F41C 23/20; F41C 23/16
USPC ..... 42/71.01, 72, 73, 74
See application file for complete search history.

(56) References Cited

U.S. PATENT DOCUMENTS 3,618,584 A * 11/1971 Pigeon ..... F41B 7/025 124/19
4,503,633 A * 3/1985 Davis ..... F41C 9/08 42/51
5,711,102 A * 1/1998 Plaster ..... F41C 23/00 42/71.01
5,813,157 A * 9/1998 Scott ..... F41C 23/22 42/71.01
5,970,642 A * 10/1999 Martin ..... F41C 23/14 42/73
D551,312 S 9/2007 Al-Mulla
D616,056 S 5/2010 Bentley
7,992,336 B2 8/2011 Phillips
8,205,371 B1 6/2012 Cook et al.
8,296,986 B1 10/2012 Cook et al.
8,397,623 B2 3/2013 Herring
8,434,252 B2 5/2013 Holmberg
D691,234 S 10/2013 Fitzpatrick et al.
D692,087 S 10/2013 Fitzpatrick et al.
8,555,541 B2 10/2013 Ingram
8,590,201 B2 11/2013 Brixius
D695,377 S 12/2013 Mayberry et al.
D700,265 S 2/2014 Mayberry et al.
8,713,833 B2 5/2014 Lewis et al.
8,720,093 B2 5/2014 Sanzo
D716,406 S * 10/2014 Storey ..... D22/108
D741,444 S * 10/2015 Cianci ..... D22/108

(Continued)

FOREIGN PATENT DOCUMENTS

EP 1512935 9/2005
EP 1953491 6/2008
EP 2636984 9/2013

OTHER PUBLICATIONS

Harrington; Ultra Hunter Rifle | Ultra Varmint; H&R Ultra Rifles; Website; Jul. 9, 2014; 5 Pages; http://www.hr1871.com/firearms/rifles/hunter.asp.

(Continued)

*Primary Examiner* — J. Woodrow Eldred
(74) *Attorney, Agent, or Firm* — Goldstein Law Offices, P.C.

(57) ABSTRACT

A gun stock, for attaching to a rifle having a receiver with a grip mounting plate and a barrel extender, the stock having a main part, a forward grip, a rear grip having a rear grip front, and a butt extending behind both the rear grip and main part. The forward grip has a grip mount for attaching to the grip mounting plate and a thumb opening. The rear grip has a pair of indentures that extend from near the butt forwardly toward the rear grip front. The main part has a front surface, a barrel extender tube having a barrel extender opening on the front surface and extending rearwardly to the butt. The barrel extender is inserted into the barrel extender opening and to the butt where it is secured to the gun stock with a barrel extender bolt.

14 Claims, 7 Drawing Sheets

(56) References Cited

U.S. PATENT DOCUMENTS

| | | | | |
|---|---|---|---|---|
| 2003/0196366 | A1* | 10/2003 | Beretta | F41C 23/18 42/71.01 |
| 2013/0232841 | A1 | 9/2013 | Knoebel et al. | |

OTHER PUBLICATIONS

Stocky's; America's Gunstock Specialist; Bobby Hart AccuBlock Apache Laminated Thumbhole Riflestock—Remington 700; Website; Jul. 9, 2014; 4 Pages; http://www.stockysstocks.com//servlet/the-650/*new!-Bobby-Hart-AccuBlock/Detail.

World Guns; Modern Firearms; Assault Rifles; Website, Jul. 9, 2014; 5 Pages; http://world.guns.ru/assault/usa/m16-m16al-m16a2-m16a3-e.html.

Military Factory; Springfield M14—Automatic Rifle—History, Specs and Pictures—Military, Security and Civilian Guns and Equipment; Springfield M14 Automatic Rifle; Website; Jul. 9, 2014; 6 Pages; http://www.militaryfactory.com/smallarms/detail.asp?smallarms_id=17.

Encyclopaedia Britannica; M16 Rifle; Website; Jul. 9, 2014; 2 Pages; http://www.britannica.com/EBchecked/topic/353341/M16-rifle.

* cited by examiner

INTEGRATED GUN STOCK

TECHNICAL FIELD

The present disclosure relates generally to an integrated gun stock. More particularly, the present disclosure relates to a gun stock integrated with a pistol grip for attaching to a rifle and configured for providing a comfort and accuracy.

BACKGROUND

Achieving accuracy when shooting a rifle is a combination of the skill of a user and the design of the rifle. Many aspects of the design have an impact on the overall accuracy. Among these are manufacturing precision, alignment of components, and proper maintenance and cleaning. Equally important, and often overlooked, is the ergonomic features that allow the rifle to be held steadily and comfortably.

Two such rifle features which assist the user in steadying the gun, thereby preventing the gun from slipping during recoil, and in generally using the gun comfortably, are the stock and the grip. While separate components of the gun, traditional gun instruction dictates that the user engage these two parts cooperatively with the stock positioned against into the user's shoulder pocket, and the user applying a firm rearward pressure against the grip to further secure the stock firmly in the shoulder to significantly reduce the effects of recoil.

However, the ergonomic and safety benefits derived from utilizing the stock and grip are negated when considering that often, grips are used on rifles for which they are not designed and therefore, are not compatible. As a result, the user often improperly grips the grip, sacrificing control over the rifle. Further, due to proprioception, or the ability of the user to sense the positioning of his limbs in space, traditional vertical grips are often incorrectly engaged by the user in efforts to grip the rifle as close to the line of the barrel, and therefore the user's line of sight. Yet further, the user is often unable to securely press the stock against his shoulder to steady the shot, while simultaneously clasping the grip to properly engage the trigger and maintain his sight alignment. As a result, the rifle can slip away from the user during firing, and an unintended target, often human, inadvertently hit.

Still further, because of their current design, rifles can easily be classified as assault weapons in certain settings, and the user banned from their use. For instance, the Federal Assault Weapons Ban of 1994 defined semi-automatic rifles with a detachable magazine and an additional pair of features including a traditional pistol grip, a folding or telescoping stock, a threaded barrel, and a muzzle-mounted grenade launcher, as assault weapons. Current legal trends also indicate a shift towards requiring only a single feature in addition to the magazine to be classified as an assault weapon. Accordingly, there is a need for a rifle design which enables comfortable, safe and controlled, and unrestricted use of the rifle.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a gun stock that attaches to a rifle and which facilitates accurate operation of the rifle. Accordingly, the present disclosure provides a gun stock that is configured with a front grip and rear grip that allows a user to hold the stock comfortably and securely.

It is another aspect of an example embodiment of the present disclosure to provide a gun stock that may be easily and economically manufactured. Accordingly the main part, and the forward grip and rear grip may be manufactured as a single continuous piece.

Accordingly, the present disclosure describes a gun stock, for attaching to a rifle having a receiver, a grip mounting plate, and a barrel extender, the stock having a main part, a forward grip, a rear grip having a rear grip front, and a butt extending behind both the rear grip and main part. The forward grip has a grip mount for attaching to the grip mounting plate and a thumb opening. The rear grip has a pair of indentures that extend from near the butt forwardly toward the rear grip front. The main part has a front surface, a barrel extender tube having a barrel extender opening on the front surface and extending rearwardly to the butt. The barrel extender is inserted into the barrel extender opening and to the butt where it is secured to the gun stock with a barrel extender bolt.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
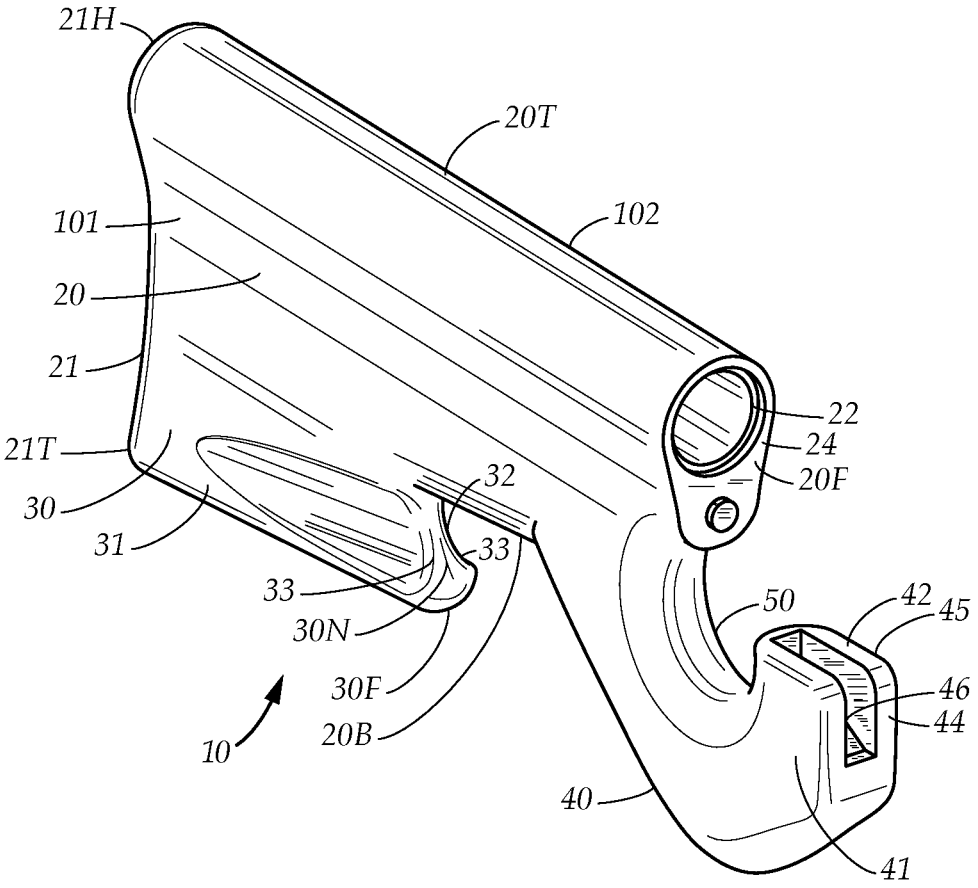
FIG. 1 is diagrammatic perspective view, showing an example embodiment of the gun stock, per se.

FIG. 1 illustrates a gun stock 10, having a main part 20, a rear grip 30, and a forward grip 40. The main part 20 has a top surface 20T, a bottom surface 20B, and a front 20F. The forward grip 40 extends beyond the front 20F of the main part 20, and is connected to the main part 20 just behind the front 20F of the main part 20. The gun stock has a butt 21 that is shared by the main part 20 and rear grip 30, the butt 21 having a heel 21H and toe 21T. The gun stock 10 has a first lateral side 101 and a second lateral side 102. The gun stock 10 may be formed using substantially a single piece of material that is continuous between the main part 20, rear grip 30, and forward grip 40. While said single piece of material is continuous between the main part 20, rear grip 30, and forward grip 40, some features may be added to said piece for the sake of manufacturing economy, such as at the butt 21 as will be described below with regard to the further embodiment of FIG. 7.

The rear grip 30 extends forwardly from the butt 21 to a rear grip front 30F, the rear grip having a bottom surface 30B which extends forwardly from the toe 21T to a mid bottom recess 23, where the bottom surface 20B of the main part 20 provides an open space between the rear grip 30 and forward grip 40, extending between the first and second lateral sides 101, 102.

The main part 20 includes a barrel extender tube 22, which includes a barrel extender tube opening 24 at the front 20F, and extends rearwardly toward the butt 20B, substantially parallel to the top surface 20T. The front surface 20F extends substantially vertically, and includes a dowel pin 25 immediately below the extender tube opening 24 of the barrel extender tube 22, the dowel pin 25 and barrel extender tube having parallel axes.

The forward grip 40 has a grip mount 41, which includes a horizontal mounting surface 42 and a vertical mounting surface 44 which meet at a right angle at a front corner 45. The grip mount 41 includes a grip mounting plate opening 46 which extends into both the horizontal mounting surface 42 and vertical mounting surface 44, angled from the front corner 45.

The forward grip 40 also has a thumb opening 50, which forms a nearly complete, yet interrupted circle. Having a robustness and curvature at its perimeter, analagously the forward grip 40 is substantially donut shaped with the thumb opening 50 creating the donut hole. The circle formed by the thumb opening 50 is interrupted by the front surface 20F of the main part and the horizontal mounting surface 42 of the grip mount 41. The grip mount 41 and front surface 20F together forming a substantially right angle, which create a missing quadrant of the thumb opening 50, like a missing bite following the donut analogy, such that the thumb opening makes substantially 270 degrees of said circle and/or donut configuration.

The rear grip 30 includes a rear grip front 30F, a first indenture 31 on the first lateral side 101 and a symmetrical second indenture 32 on the second lateral side 102. The indentures 31, 32 extend conically from near the butt 21 where they are relatively shallow, expanding in width toward the bottom 30B of the rear grip 30 and deepening as they extend toward the rear grip front 30F where they create a pair of arced notches 33 that nearly meet at a neck 30N.

Figure 3A:
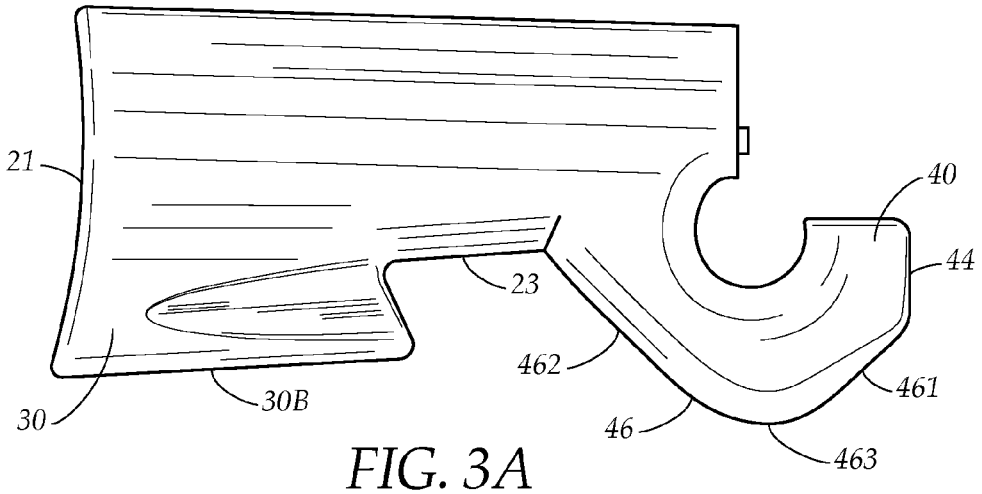
FIG. 3A is a side elevational view showing an example embodiment wherein the butt of the stock is concave.
Figure 3B:
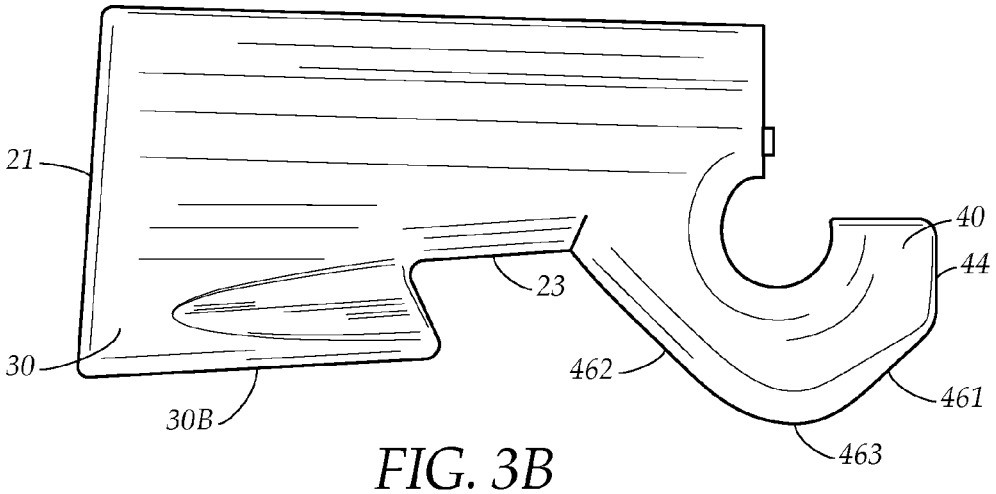
FIG. 3B is a side elevational view showing an example embodiment wherein the butt of the stock is substantially flat.

Referring to FIGS. 3A and 3B, the forward grip 40 has a curved lower surface 46 which dips significantly between the vertical mounting surface 44 and the mid bottom recess 23. In particular, the curved lower surface 46 may include a declining edge 461, extending from the vertical mounting surface 44; an inclined edge 462 extending from the mid bottom recess 23; and a curved belly 463 between the declining edge 461 and the inclined edge 462. In the embodiment illustrated, the curved belly 463 extends lower than the bottom 30B of the rear grip 30. Note that FIG. 3A and FIG. 3B show slightly different embodiments. In particular in FIG. 3A the butt 21 is curved, and in FIG. 3B the but is substantially straight/flat.

Figure 2:
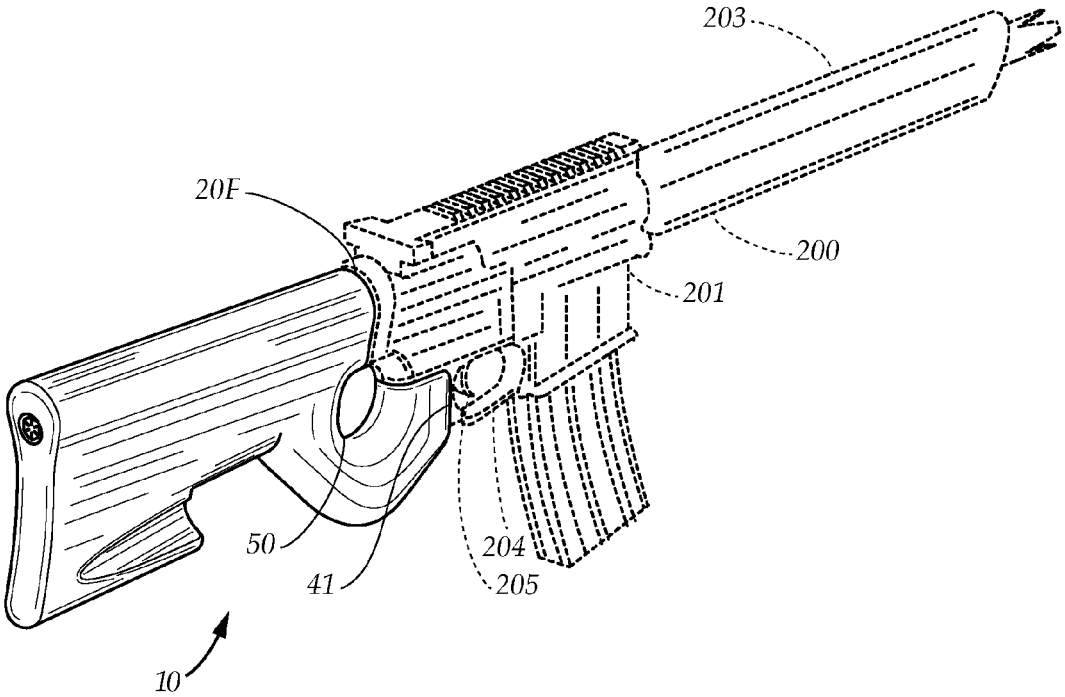
FIG. 2 is a diagrammatic perspective view, showing an example embodiment of the gun stock installed on a rifle, the rifle shown in phantom.

Referring now to FIG. 2, the gun stock 10 is shown mounted onto a rifle 200 having a receiver 201 and a barrel 203. The receiver 201 including a trigger guard 204 and a trigger 205. The front 20F of the main part is mounted against the receiver 201, and the grip mount 41 is secured adjacent to the trigger guard 204. Note that the opening formed by thumbhole 50 forms a complete, closed circle with the receiver 201.

Figure 5:
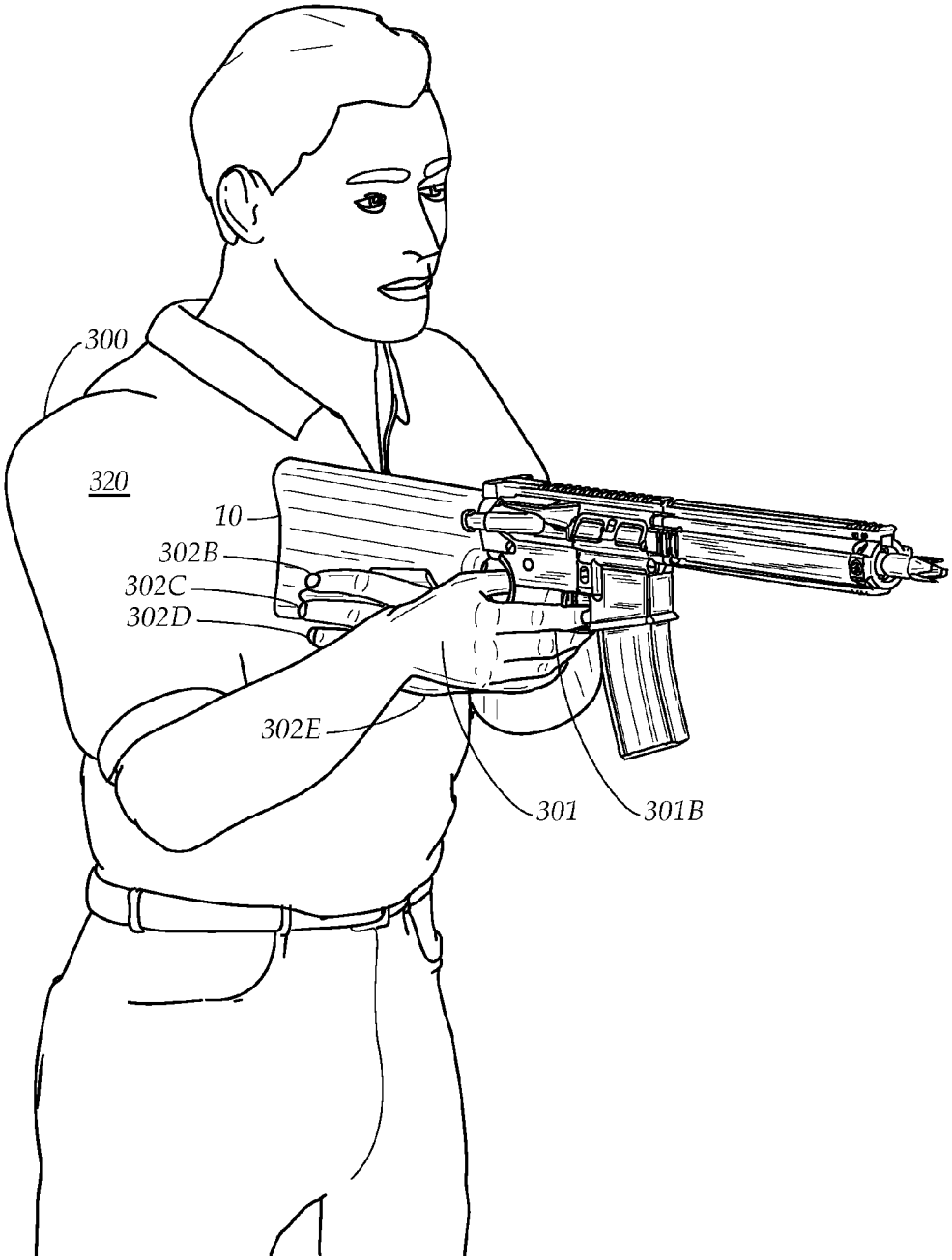
FIG. 5 is a diagrammatic perspective view showing the rifle with the stock installed, being held by a user.
Figure 6:
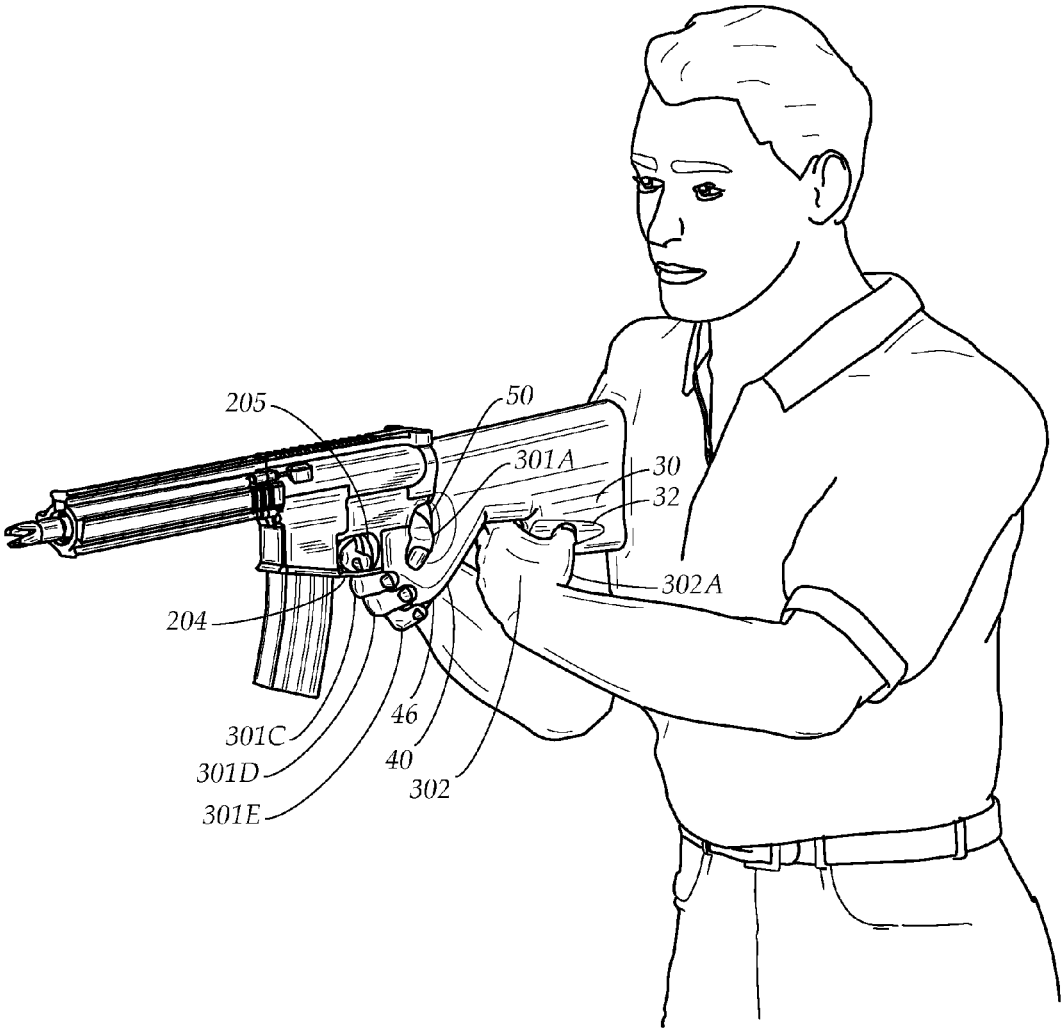
FIG. 6 is an alternative perspective view, showing the rifle held by the user and detailing a possible hand position when using the stock.

Referring to FIGS. 5 and 6, a user 300 is holding the rifle 200 having the gun stock 10 installed. The user 300 has a chest 320, a first hand 301, and a second hand 302. The first hand 301 has a thumb 301A, an index finger 301B, a middle finger 301C, a ring finger 301D, and a pinky 301E. The second hand 302 has a thumb 302A, an index finger 302B, a middle finger 302C, a ring finger 302D, and a pinky 302E.

The first hand 301 is positioned forwardly on the rifle 200, with the thumb 301A extending through the thumb hole 50, the index finger 301B above the trigger guard 204 and against the trigger 205, and the middle finger 301C, ring finger 301D, and pinky 301E wrapped comfortably around the curved lower surface 46 of the forward grip 40. Note that spacing between the thumb hole 50 and the curved lower surface 46 is preferably significant, such as more than an inch. This spacing allow the fingers to comfortably curl around the curved lower surface 46 as the thumb 301A extends through the thumb hole 50. The spacing can be selected to ergonomically fit the palm by being roughly equivalent to spacing between the thumb and other fingers on an average adult hand.

The second hand 302 is used to grasp the rear grip 30, such that the thumb 302A extends against the second indenture 32, while the index finger 302B extends on the first indenture 31.

Figure 4:
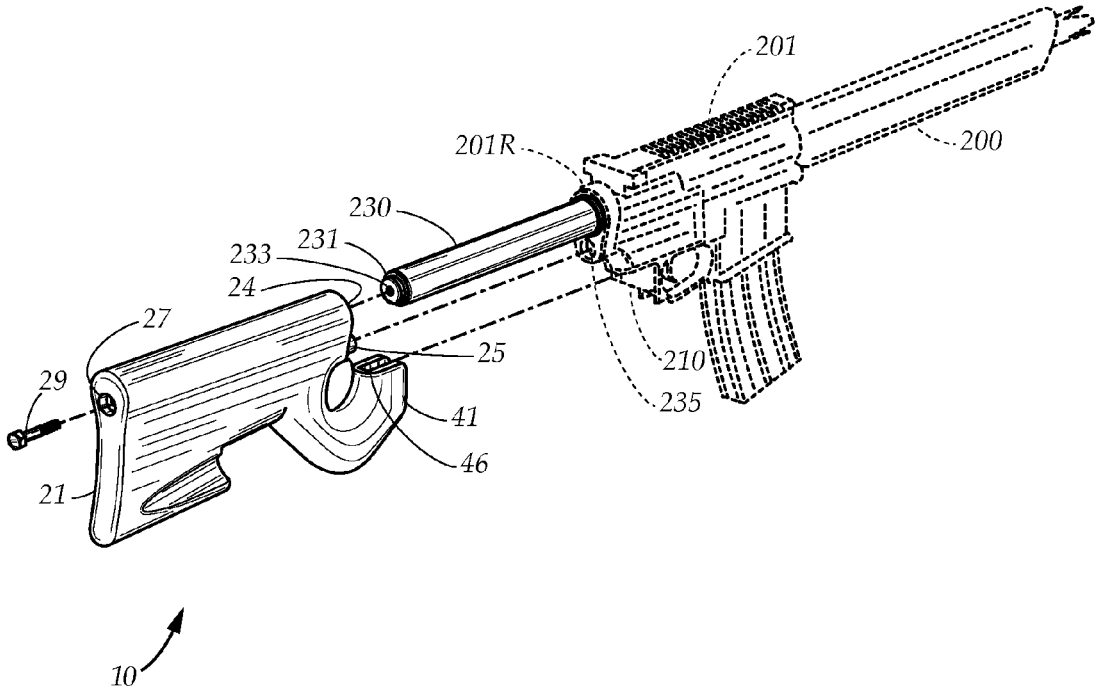
FIG. 4 is an exploded view, showing an example embodiment of the gun stock being installed onto the rifle.

Referring now to FIG. 4, further detail is shown regarding the interconnection between the rifle 200 and gun stock 10. In particular, the receiver 201 includes a grip mounting plate 210 adjacent to the trigger guard 204, and has a rear surface 201R. A barrel extender 230 extends rearwardly from the rear surface 201R to a barrel extender end 231. A threaded opening 233 is located in the barrel extender end 231. The rear surface 201R of the receiver 201 has a dowel hole 235 immediately below the barrel extender 230.

The butt 21 of has a rear opening 27 for allowing a barrel extender bolt 29 to extend therein. In particular, to mate the gun stock 10 to the rifle 200, the barrel extender 230 is extended into the barrel extender opening 24 of the barrel extender tube 22 (seen in FIG. 1), until the barrel extender end 231 nearly reaches the butt 21, bringing the dowel pin 25 into the dowel hole 235. At the same time, the grip mounting plate 210 extends into the grip mounting plate opening 46 of the grip mount 41. When all parts are suitably seated, the barrel extender bolt 29 is extended through the rear opening 27 of the butt 21 and into the threaded opening 233 in the barrel extender end 231. Accordingly, with the tightening of the barrel extender bolt 29, the stock 10 is secured to the rifle 200.

Figure 7:
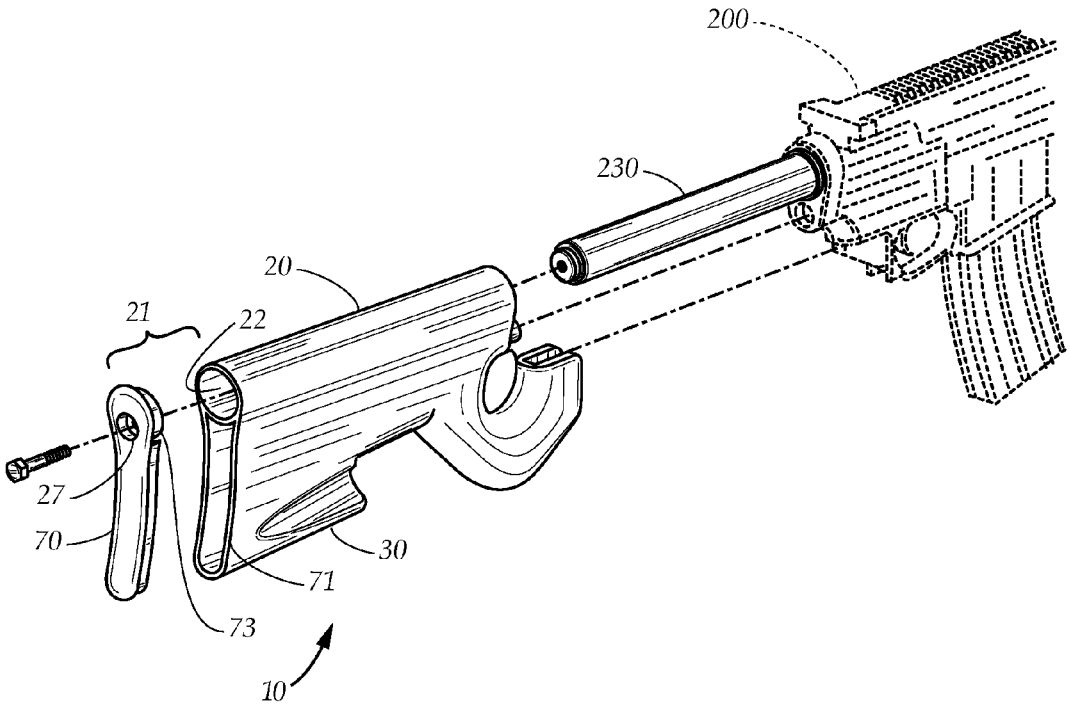
FIG. 7 is an exploded view, showing a further example embodiment of the stock being installed onto the rifle.

FIG. 7 shows a further example embodiment of the gun stock 10. In particular, for the sake of manufacturing economy, using processes such as injection molding, the gun stock includes a butt plate 70 which forms part of the butt 21. In particular, the butt plate 70 is a separate panel that fits onto the main part 20, rear grip 30 and front grip 40 combination after the main part 20, rear grip 30, and front grip 40 is manufactured in a single piece. By this embodiment, the main part 20 and rear grip 30 has a back opening 71 for accepting the butt plate 70. The barrel extender tube 22 extends to and is itself open at the back opening 71. The butt plate 70 includes a collar 73 which inserts and seats in the barrel extender tube 22. The rear opening 27 is located on the butt plate 70 and is substantially concentric with the collar 73. Accordingly, and once the barrel extender 230 is fully extended into the barrel extender tube 22, the butt plate 70 may be seated in the back opening 71 of the main part 20 and the extender tube bolt 29 inserted through the rear opening 27 to both secure the stock 10 to the rifle 200 and to secure the butt plate 70 to the main part 20 and rear grip 30.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an integrated gun stock. The disclosure is illustrated by example in the drawing figures, and throughout the written description. It should be understood that numerous variations are possible, while adhering to the inventive concept. Such variations are contemplated as being a part of the present disclosure.

What is claimed is:

1. A gun stock, for attaching to a rifle having a receiver having a trigger guard, a grip mounting plate adjacent to the trigger guard, and a barrel extender having a barrel extender end having a threaded opening, comprising:

a main part having a top surface, a bottom surface, and a front surface, the main part having a barrel extender tube having a barrel extender tube opening at the front surface;

a rear grip, having a bottom surface and extending below the main part;

a butt having a heel adjacent to the top surface or the main part and a toe at the rear grip; and a forward grip attached the main grip behind the front surface of the main grip and extending forwardly from the main grip, the forward grip having a thumb opening and a gripmount having a horizontal mounting surface for securing to the grip mounting plate of the rifle, the thumb opening forming a circle that is interrupted by the front surface of the main part and the horizontal mounting surface of the grip mount.

2. The gun stock as recited in claim 1, wherein the rear grip has a rear grip front and its bottom surface extends forwardly from the toe to the rear grip front, wherein the forward grip has a curved lower surface, and wherein the gun stock has first and second lateral sides and a mid bottom recess where the bottom surface of the main part provides an open space between the rear grip front and the curved lower surface of the forward grip, said mid bottom recess extending between the first and second lateral sides.

3. The gun stock as recited in claim 2, wherein the rear grip has a first indenture on the first lateral side and a second indenture on the second lateral side, the indentures extend conically from near the butt where they are relatively shallow, and expand in width toward the bottom of the rear grip and deepening as they extend toward the rear grip front.

4. The gun stock as recited in claim 3, wherein the grip mount has a vertical mounting surface that meets the horizontal mounting surface at a substantially right angle and a front corner between the vertical mounting surface and horizontal mounting surface, and wherein the grip mount has a grip mounting plate opening which extends into both the horizontal mounting surface and vertical mounting surface, angled from the front corner.

5. The gun stock as recited in claim 4, further having a barrel extender bolt, wherein the butt has a rear opening for allowing a barrel extender bolt to extend therein, such that when the barrel extender is extended into the barrel extender opening of the barrel extender tube until the barrel extender end nearly reaches the butt, the barrel extender bolt is extended through the rear opening of the butt and into the threaded opening in the barrel extender end to secure the gun stock to the rifle.

6. The gun stock as recited in claim 5, wherein the curved lower surface includes a declining edge extending from the vertical mounting surface of the forward grip, an inclined edge extending from the mid bottom recess, and a curved belly between the declining edge and the inclined edge.

7. The gun stock as recited in claim 6, wherein the curved belly extends lower than the bottom surface of the rear grip, and the curved belly extends at least one inch from the thumb opening.

8. The gun stock as recited in claim 7, wherein the butt further comprises a butt plate and a butt opening, the barrel extender tube open at the butt opening, the butt plate having a collar for seating in the barrel extender tube when mounting the butt plate at the butt opening.

9. A gun stock, for attaching to a rifle having a receiver having a trigger guard, a grip mounting plate adjacent to the trigger guard, and a barrel extender having a barrel extender end having a threaded opening, comprising:

a pair of lateral sides, including a first lateral side and a second lateral side;

a main part, a top surface, a bottom surface, and a front surface, the main part having a barrel extender tube extending substantially parallel to the top surface and having a barrel extender tube opening at the front surface;

a rear grip extending below the main part, the rear grip having a bottom surface and a rear grip front, the rear grip extending below the main part, the rear grip having a first indenture on the first lateral side and a second indenture on the second lateral side;

a butt having a heel adjacent to the top surface or the main part and a toe at the rear grip; and a forward grip attached the the main grip behind the front surface of the main grip and extending forwardly from the main grip, the forward grip having a thumb opening and a gripmount having a horizontal mounting surface for securing to the grip mounting plate of the rifle, the thumb opening forming a circle that is interrupted by the front surface of the main part and the horizontal mounting surface of the grip mount.

10. The gun stock as recited in claim 9, wherein the indentures extend conically from near the butt where they are relatively shallow, and expand in width toward the bottom of the rear grip and deepening as they extend toward the rear grip front.

11. The gun stock as recited in claim 10, further having a barrel extender bolt, wherein the butt has a rear opening for allowing a barrel extender bolt to extend therein, such that when the barrel extender is extended into the barrel extender opening of the barrel extender tube until the barrel extender end nearly reaches the butt, the barrel extender bolt is extended through the rear opening of the butt and into the threaded opening in the barrel extender end to secure the gun stock to the rifle.

12. The gun stock as recited in claim 11, wherein the bottom surface of the rear grip extends forwardly from the toe to the rear grip front, wherein the forward grip has a curved lower surface, wherein the gun stock has first and second lateral sides and a mid bottom recess where the bottom surface of the main part provides an open space between the rear grip front and the curved lower surface of the forward grip, said mid bottom recess extending between the first and second lateral sides, wherein the curved lower surface includes a declining edge extending from the vertical mounting surface of the forward grip, an inclined edge extending from the mid bottom recess, and a curved belly between the declining edge and the inclined edge, and wherein the curved belly extends lower than the bottom surface of the rear grip, and the curved belly extends at least one inch from the thumb opening.

13. The gun stock as recited in claim 12, wherein the grip mount has a vertical mounting surface that meets the horizontal mounting surface at a substantially right angle and a front corner between the vertical mounting surface and horizontal mounting surface, and wherein the grip mount has a grip mounting plate opening which extends into both the horizontal mounting surface and vertical mounting surface, angled from the front corner.

14. The gun stock as recited in claim 13, wherein the curved belly extends lower than the bottom surface of the rear grip, and the curved belly extends at least one inch from the thumb opening wherein the butt further comprises a butt plate and a butt opening, the barrel extender tube open at the butt opening, the butt plate having a collar for seating in the barrel extender tube when mounting the butt plate at the butt opening.

* * * * *